United States Patent [19]

Tolasch et al.

[11] 4,365,702

[45] Dec. 28, 1982

[54] APPARATUS FOR TRANSPORT AND TEMPORARY STORAGE OF CIGARETTES OR THE LIKE BETWEEN PRODUCING AND PROCESSING MACHINE

[75] Inventors: Gerhard Tolasch; Horst Bäse, both of Hamburg; Jürgen Bantien, Hamwarde, all of Fed. Rep. of Germany

[73] Assignee: Hauni-Werke Körber & Co. KG, Hamburg, Fed. Rep. of Germany

[21] Appl. No.: 130,392

[22] Filed: Mar. 14, 1980

Related U.S. Application Data

[63] Continuation of Ser. No. 6,221, Jan. 24, 1979, abandoned, which is a continuation of Ser. No. 804,338, Jun. 7, 1977, abandoned.

[30] Foreign Application Priority Data

Sep. 10, 1976 [DE] Fed. Rep. of Germany ..... 2640719
Nov. 17, 1976 [DE] Fed. Rep. of Germany ..... 2652363

[51] Int. Cl.[3] ..... B65G 1/00

[52] U.S. Cl. ..... 198/347; 198/358; 198/437

[58] Field of Search ..... 198/347, 356–358, 198/363, 437, 438, 441, 447, 448, 502, 568, 572, 573, 575, 577, 601, 855, 856; 414/294, 296; 131/21 R, 21 A, 21 B, 25, 280, 282, 283, 909; 53/148, 151, 236, 503

[56] References Cited

U.S. PATENT DOCUMENTS

| | | | |
|---|---|---|---|
| 3,122,231 | 2/1964 | Pence et al. | 198/347 |
| 3,355,004 | 11/1967 | Rupert | 198/572 |
| 3,620,349 | 11/1971 | McCombie | 198/358 |
| 3,952,854 | 4/1976 | Selonke et al. | 198/601 |
| 4,142,622 | 3/1979 | Seragnoli | 198/347 |
| 4,273,233 | 6/1981 | Hinchcliffe et al. | 198/347 |

FOREIGN PATENT DOCUMENTS

| | | | |
|---|---|---|---|
| 2256420 | 5/1974 | Fed. Rep. of Germany | 198/568 |
| 2353806 | 5/1974 | Fed. Rep. of Germany | 198/347 |

*Primary Examiner*—Joseph E. Valenza
*Attorney, Agent, or Firm*—Kontler, Grimes & Battersby

[57] ABSTRACT

Apparatus for transporting rod-like articles in the form of cigarettes or filter rod sections from one or more makers to a packing or other consuming machine has a pair of superimposed surge bins which receive articles from a first transporting unit when the output of the maker or makers exceeds the requirements of the consuming machine, and a second transporting unit which conveys articles from the surge bins to the consuming machine when the requirements of the consuming machine exceed the output of the maker or makers. A control system is provided to effect the filling of the upper surge bin prior to filling of the lower surge bin and to effect evacuation of the contents of the lower surge bin prior to evacuation of the contents of the upper surge bin. Each transporting unit has one or more pairs of endless belts and/or ducts which convey multilayer streams of articles.

22 Claims, 5 Drawing Figures

APPARATUS FOR TRANSPORT AND TEMPORARY STORAGE OF CIGARETTES OR THE LIKE BETWEEN PRODUCING AND PROCESSING MACHINE

CROSS-REFERENCE TO RELATED CASES

This is a continuation of patent application Ser. No. 006,221 filed Jan. 24, 1979, now abandoned. The application Ser. No. 006,221 is a continuation of patent application Ser. No. 804,338 filed June 7, 1977, now abandoned.

BACKGROUND OF THE INVENTION

The present invention relates to apparatus for manipulating cigarettes, filter rod sections or analogous rod-shaped articles which constitute or form part of smokers' products, and more particularly to improvements in apparatus for transporting such articles from one or more producing machines to one or more consuming or processing machines. Still more particularly, the invention relates to apparatus which can transport and temporarily store cigarettes, filter rod sections or the like between at least one producing and at least one consuming machine.

It is known to install a variable-capacity reservoir adjacent to the path of travel of cigarettes or the like on their way from a maker to a consuming machine (e.g., from a machine for mass-production of cigarettes or filter rod sections to a cigarette packing machine or to a sender which propels filter rod sections to the magazines of two or more filter tipping machines). The volume of the reservoir varies in dependency on changes in the ratio between the requirements of the consuming machine and the output of the maker. The height of the supply of articles in the reservoir cannot be increased at will because the articles (especially cigarettes) of the lowermost layer are likely to be deformed or otherwise damaged if the height of the stack of articles thereabove is excessive. Attempts to avoid such damage to articles, while providing room for storage of relatively large quantities of articles, include the provision of very long reservoirs, often in the form of helical surge bins. Such reservoirs are expensive and occupy a substantial amount of space so that they cannot be installed in all existing plants wherein cigarettes or like rod-shaped articles must be transported from one or more makers to one or more consuming machines. Furthermore, the transport of articles along helical paths during introduction into or evacuation from the reservoir presents many problems, especially as concerns the integrity of articles. Thus, the tobacco-containing ends of articles are likely to lose tobacco in response to repeated changes in the direction of movement between the maker and the consuming machine as well as in the interior of a reservoir.

OBJECTS AND SUMMARY OF THE INVENTION

An object of the invention is to provide an apparatus which can be used for transport of cigarettes, filter rod sections or analogous rod-shaped articles from one or more producing machines to one or more consuming machines and is capable of storing a substantial supply of such articles between the producing and consuming machines to allow for uninterrupted operation of the consuming machine or machines during temporary stoppage or deceleration of the producing machine or machines and vice versa.

Another object of the invention is to provide novel and improved article storing means for use in the above outlined apparatus.

A further object of the invention is to provide storing means whose length need not exceed (and can be substantially less than) the length of conventional storing means in spite of the fact that the improved storing means can provide room for temporary accumulation of a large quantity of articles.

An additional object of the invention is to provide the apparatus with means which can temporarily store large quantities of articles without any deformation of and/or other damage to confined commodities.

An ancillary object of the invention is to provide a novel and improved array of surge bins for use in the above outlined apparatus.

An additional object of the invention is to provide an apparatus which can be installed between existing producing and consuming machines for rod-shaped articles which constitute or form part of smoker's products.

Another object of the invention is to provide an apparatus whose operation is automated to such an extent that the apparatus can be supervised by a single attendant simultaneously with supervision of one or more additional apparatus.

One feature of the invention resides in the provision of an apparatus which is used to transport streams of cigarettes, filter rod sections or analogous rod-shaped articles from at least one producing machine (e.g., a cigarette maker or a filter rod maker) to at least one consuming or processing machine (e.g., a cigarette packer or a pneumatic sender for transport of filter rod sections to a plurality of filter tipping machines). The apparatus comprises storing means including a plurality of variable-capacity reservoirs (preferably of the type known as surge bins) disposed one above the other and each having an opening which constitutes an inlet during admission of articles into and an outlet during evacuation of articles from its interior, a first transporting unit including means for feeding articles from the producing machine to the reservoirs when the output of the producing machine exceeds the requirements of the consuming machine, and a second transporting unit having means for conveying articles from the reservoirs to the consuming machine when the requirements of the consuming machine exceed the output of the producing machine.

The apparatus preferably further comprises control means for effecting the admission of articles into an upper reservoir prior to admission of articles into the reservoir therebelow, and for effecting the evacuation of articles from a lower reservoir prior to evacuation of articles from the reservoir thereabove. If the storing means comprises two reservoirs including a first or upper reservoir and a second or lower reservoir, the control means may include a first sensor which is adjacent to the path of articles supplied by the feeding means of the first transporting unit and is operative to produce first signals in response to changing pressure of articles in the path, first and second reversible electric motors or analogous prime mover means which are operable to change the volume of the first and second reservoirs, means for operating the first and thereupon the second prime mover means to increase the volume of the respective reservoirs when the pressure of articles against the first sensor increases, and for operating the first prime mover means to reduce the volume of the first reservoir when the pressure of articles against the first sensor decreases, a second sensor adjacent to the path of articles from the second reservoir to the second transporting unit and operative to produce second signals in response to decreasing pressure of articles in the second reservoir, and means for operating the second prime mover means to reduce the volume of the second reservoir while the pressure of articles against the second sensor decreases.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2:
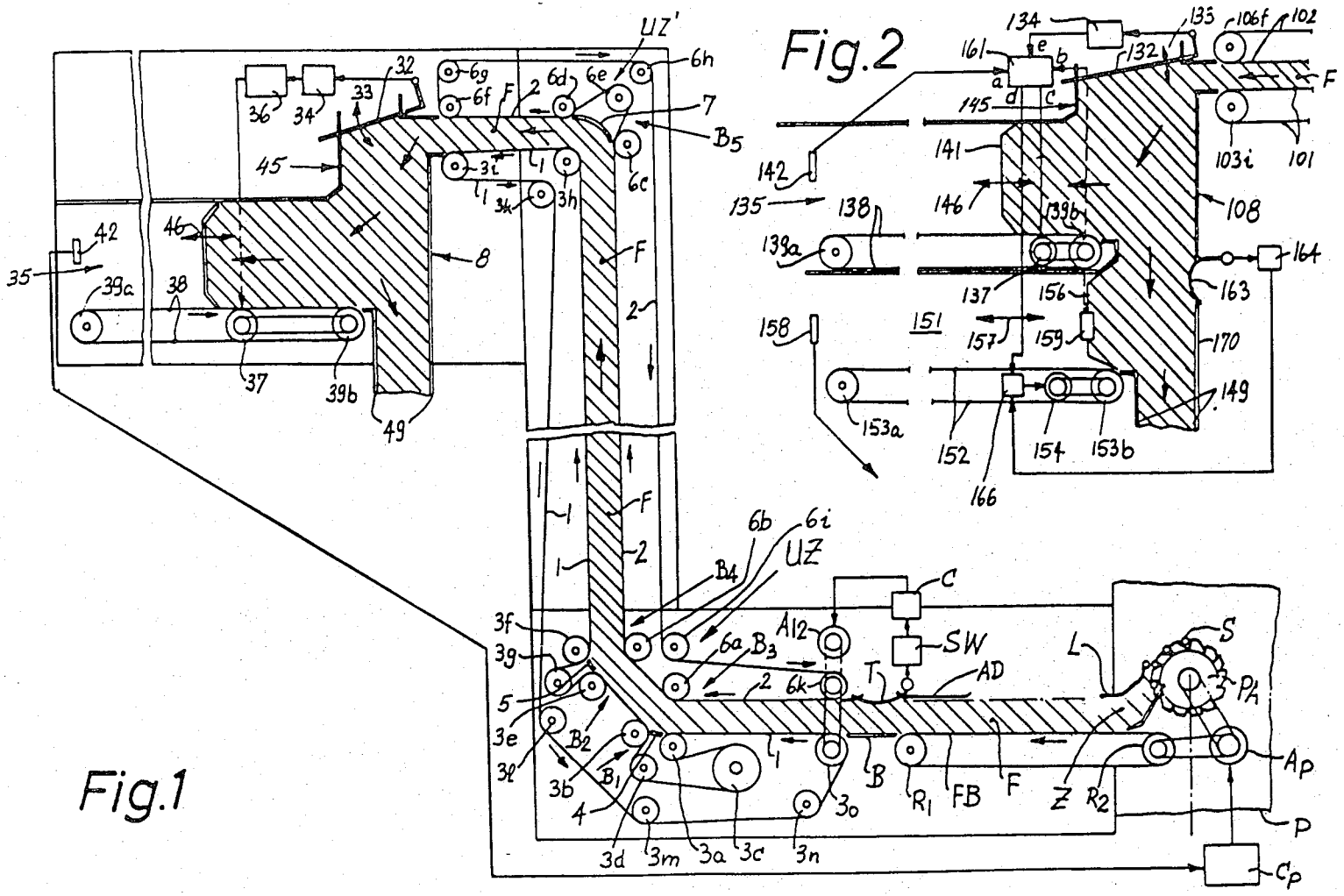
FIG. 1 is a schematic side elevational view of an apparatus which comprises a single reservoir.
FIG. 2 is a fragmentary schematic elevational view of an apparatus which embodies one form of the invention in that it comprises two variable-capacity reservoirs in the form of surge bins.

Referring to FIG. 1, there is shown an apparatus which moves the output of a producing machine P to a consuming machine having a conveyor 49 constituting a vertical duct. The machine P produces rod-shaped articles S, e.g., filter rod sections or cigarettes, and comprises a rotary drum-shaped take-off conveyor PA having peripheral flutes which transport a single row of articles S sideways to an article collecting or accumulating station Z. The station Z is located above the upper reach of an endless conveyor belt FB on which the single row of articles delivered by the conveyor PA is converted into a multi-layer stream F of parallel articles. The conveyor belt FB is trained over rollers R1 and R2 and is driven in synchronism with the moving parts of the producing machine P. A flexible cover L overlies the upper reach of the belt conveyor FB at the station Z and rests on the uppermost layer of the stream F; the purpose of this cover is to reduce the likelihood of misalignment of articles S. The articles which form the stream F are assumed to be parallel to each other and to move sideways.

The leader of the multi-layer stream F advances over a stationary bridge or guide B which is in line with the discharge end of the upper reach of the conveyor belt FB, and such leader thereupon enters the space between two elongated endless belt conveyors 1 and 2 which constitute a transporting unit and define for the stream an elongated path having several mutually inclined sections. In the embodiment of FIG. 1, the first section of the path which is defined by the transporting unit including the conveyors 1 and 2 is substantially horizontal, the second section slopes upwardly at an angle of approximately 45 degrees, the third section is substantially vertical, and the fourth section is substantially horizontal. The means for driving the conveyors 1 and 2 comprises an electric motor A12 whose operation is controlled by a sensor T pivotably mounted in the frame of the apparatus and resting on the uppermost layer of articles S forming the stream F in the region above the stationary bridge B. The sensor T tends to pivot anticlockwise by gravity and is pivoted clockwise in response to pressure applied to its convex underside by the uppermost layer of articles S in the stream F. The sensor T actuates a switch SW which is in circuit with a control unit C having an output connected with the motor A12. The switch SW causes the control unit C to start the motor A12 when the pressure of articles against the sensor T reaches a predetermined value and the motor A12 is arrested when the pressure of articles S upon the sensor T drops below such value. This insures that the conveyors 1 and 2 invariably receive a stream each increment of which contains the same number of articles or wherein the number of articles fluctuates within a narrow range. This holds true even if the rate at which the producing machine P turns out articles S fluctuates within a very wide range, e.g., even if the machine P is operated intermittently. The reference character AD denotes a fixed top wall which overlies the stream F immediately ahead of the pivot for the sensor T.

The prime mover Ap of the producing machine P is an electric motor which drives the conveyor PA, the roller R2 and certain other moving parts of the machine P. The motor Ap can be arrested in response to signals from a control unit Cp.

The aforementioned second section of the path defined by the conveyors 1 and 2 is located at an orientation changing station UZ where the stream F is caused to gradually change the direction of its movement from horizontal to vertical. The change in direction of movement of the stream F takes place in several stages to insure continuity of the stream all the way from the intake end to the discharge end of the path along which the articles S move in the space between the conveyors 1 and 2. The article-engaging reach of the conveyor 1 is caused to move away from contact with the articles S at a locus B1 in the relatively narrow gap between two rollers 3*a* and 3*b*. The gap is bridged by a stationary guide 4 whose concave side faces the adjacent lowermost layer of the stream F. The conveyor 1 is trained over the roller 3*a*, thereupon over two additional rollers 3*c*, 3*d* and then over the roller 3*b* which returns the conveyor 1 into contact with the adjacent outermost layer of articles S. The inclination of that portion of the conveyor 1 which travels toward the roller 3*a* is different from the inclination of the conveyor portion downstream of the roller 3*b*. The roller 3*c* is mounted in such a way that it causes the conveyor 1 to reverse the direction of its movement between the rollers 3*a* and 3*d*. The gap which is bridged by the arcuate guide 4 is preferably narrow to insure that positive transport of the adjacent outermost layer of the stream F is practically uninterrupted.

The direction of movement of the conveyor 1 is changed again at a locus B2 where the stream F changes the direction of its movement through an angle of approximately 45 degrees and begins to advance vertically upwardly. The conveyor 1 is trained over rollers 3*e*, 3*f*, 3*g* and is remote from the adjacent layer of articles S in the narrow gap between the rollers 3*e* and 3*f*. Such gap is bridged by a second arcuate guide 5 whose concave side faces the adjacent layer of articles S. The roller 3*g* changes the direction of movement of those increments of the conveyor 1 which advance from the roller 3*e* toward the roller 3*f*.

An advantage of the just described rollers 3*a*–3*g* and guides 4, 5 is that the direction of movement of the stream F can be changed by 90 degrees without resorting to a discrete conveyor between the rollers 3*a* and 3*f*. The means for changing the direction of movement of the conveyor 1 from vertical to horizontal comprises a single roller 3*h*. Such change in the direction of movement presents no problems because the adjacent layer of articles S travels with the convex side of the conveyor 1. The latter is further trained over rollers 3*i*, 3*k*, 3*l*, 3*m*, 3*n* and 3*o* before it returns to the roller 3*a*. The roller 3*o* is driven by the motor A12.

The deflection of conveyor 2 at the station UZ presents no problems because the adjacent layer of articles S contacts the convex side of the conveyor. Therefore, the latter is simply trained over two idler rollers 6*a*, 6*b* which are respectively mounted at locations B3 and B4 opposite the guides 4 and 5. Three rollers 6*c*, 6*d* and 6*e* are needed to change the direction of movement of the conveyor 2 at the station UZ′ (locus B5) where the stream F leaves the vertical section and enters the horizontal section of its path. The gap between the rollers 6*c*, 6*d* is wider than the aforementioned gaps and is bridged by a stationary guide 7 whose concave side faces the adjacent layer of articles S. The roller 6*e* guides the conveyor 2 on its way from the roller 6*c* toward the roller 6*d*. The other reach of the conveyor 2 is trained over rollers 6*f*, 6*g*, 6*h*, 6*i* and 6*k*. The roller 6*k* is driven by the motor A12 in such a way that the conveyors 1 and 2 move at the same speed. That portion of the conveyor 2 which advances from the roller 6*d* toward the roller 6*f* engages the articles S of the upper layer of the stream F so that the stream is positively advanced all the way to the discharge end of the transporting unit including the conveyors 1 and 2.

The provision of rollers 6*c*–6*e* and guide 7 at the locus B5 renders it possible to dispense with a discrete conveyor between the rollers 6*c* and 6*d*.

The conveyors 1 and 2 admit successive increments of the stream F into a vertical duct 45 whose upper end is open. The uppermost stratum of articles S in the duct 45 is contacted by a pivotable sensor 32 which actuates a switch 34 in circuit with a control unit 36 for a prime mover here shown as a reversible electric motor 37. The directions in which the sensor 32 is pivotable about its hinge are indicated by a double-headed arrow 33. The motor 37 drives one (39*b*) of two rollers 39*a*, 39*b* for an endless conveyor belt 38 whose upper reach constitutes the mobile bottom wall of a variable-capacity reservoir 35 of the type known as surge bin. The upper reach of the belt 38 is connected with a reciprocable end wall 41 of the surge bin 35. When the articles S in the duct 45 cause the sensor 32 to pivot clockwise, the motor 37 is started in a direction to move the end wall 41 to the left, i.e., away from a stationary end wall 8 of the surge bin 35. When the pressure upon the sensor 32 decreases so that it pivots in a counterclockwise direction, as viewed in FIG. 1, the motor 37 is caused to move the end wall 41 in a direction to the right. The directions of movement of the end wall 41 are indicated by a double-headed arrow 46.

The end wall 41 actuates a limit switch 42 when the surge bin 35 is filled to capacity. The switch 42 then transmits a signal to the control unit Cp which arrests the prime mover Ap of the producing machine P. The lower end of the duct 45 discharges articles S directly into the right-hand end portion of the surge bin 35 adjacent to the stationary end wall 8. This end wall merges into the right-hand side wall of the aforementioned duct 49 forming part of a transporting unit which delivers cigarettes S to the consuming machine, e.g., a packing machine for cigarettes. If the articles S are filter rod sections, the duct 49 may form part of a transporting unit for delivery of filter rod sections to a pneumatic sender which transports filter rod sections to the magazines of two or more filter tipping machines for cigars, cigarillos or cigarettes.

The duct 49 (wherein the articles S descend by gravity) can be replaced by a different conveyor which positively advances the articles S downwardly into the consuming machine proper. For example, such conveyor may include two endless belts defining a space for the transport of a multi-layer stream of articles S into the consuming machine.

it will be noted that the surge bin 35 communicates with the discharge end of the transporting unit 1, 2 (via duct 45) and with the inlet at the upper end of the duct 49, and that the surge bin extends laterally of such discharge end and inlet.

The operation:

The single row of articles S which are delivered by the take-off conveyor PA of the producing machine P enters the collecting station Z and is converted into the multi-layer stream F on the upper reach of the conveyor belt FB. The stream F advances toward and into the intake end of the space between the article feeding conveyors 1 and 2. The articles S of the uppermost layer of the stream F act upon the sensor T which regulates the motor A12 by way of the switch SW and control unit C in such a way that the number of layers in the stream between the conveyors 1 and 2 is constant. During the initial stage of movement in the space between the conveyors 1 and 2, each increment of the stream F travels along a horizontal path (between the rollers 3*o*, 6*k* on the one hand and the rollers 3*a*, 6*a* on the other hand). The increments are thereupon caused to move upwardly during travel through the orientation changing station UZ and enter the vertical section of the space between the conveyors 1 and 2 to move upwardly toward and through the second orientation changing station UZ′. The articles S thereupon advance along a horizontal path toward and into the chute 45. Under normal circumstances (namely, when the requirements of the consuming machine match the output of the producing machine P), the articles S advance through the opening (which constitutes an inlet or an outlet) at the right-hand end of the surge bin 35 and into the duct 49.

If the consuming machine is arrested or the duct 49 withdraws the articles at a lower than normal rate, the rate at which the articles pass through the duct 49 per unit of time varies. This causes the sensor 32 above the duct 45 to pivot in a clockwise direction whenever the rate of article delivery decreases. Analogously, if the rate at which the conveyor PA delivers articles S to the collecting station Z decreases or becomes irregular, the sensor 32 pivots in a counterclockwise direction. In either event, the sensor 32 actuates the switch 34 which causes the control unit 36 to start the motor 37 in appropriate direction so that the upper reach of the conveyor belt 38 moves the end wall 41 toward the end wall 8 when the requirements of the consuming machine exceed the output of the producing machine P and that the end wall 41 moves away from the end wall 8 when the output of the machine P exceeds the requirements of the consuming machine. The surge bin 35 collects the surplus as long as the end wall 41 is still out of contact with the limit switch 42. The latter causes the control unit Cp to arrest the prime mover Ap of the producing machine P when the surge bin 35 is filled to capacity. Under normal circumstances, the mobile end wall 41 will move back and forth to compensate for fluctuations in requirements of the consuming machine and/or in the output of the producing machine P, i.e., the surge bin 35 will normally store a certain supply of articles S but will not be filled to capacity.

It is clear that the limit switch 42 can be replaced with a battery of limit switches which are adjacent to the path of the end wall 41, or to the path of a suitable trip on the conveyor 38, and each of which can cause the prime mover Ap of the producing machine P to operate at a different speed. Thus, the prime mover Ap will be arrested when the end wall 41 or the aforementioned trip actuates that limit switch which is remotest from the end wall 8; the other limit switches will merely change the speed of the prime mover Ap. It is further within the purview of the invention to replace the limit switch 41 with a different signal generating device, e.g., with an adjustable potentiometer, which gradually increases the speed of the prime mover Ap while the end wall 41 moves in a direction to the right and which gradually reduces the speed of the prime mover Ap when the end wall 41 moves in the opposite direction as a result of admission of additional articles into the surge bin 35. Thus, the prime mover Ap can be a constant speed motor, a motor whose speed can be varied in stepwise fashion, or a motor whose speed can be varied infinitely between zero and a selected maximum speed.

FIG. 2 shows a portion of an apparatus which embodies one form of the invention and wherein all such parts which are identical with or clearly analogous to corresponding parts of the apparatus of FIG. 1 are denoted by similar reference characters plus 100. The basic difference is that the apparatus of FIG. 2 comprises two reservoirs or surge bins 135 and 151, i.e., that the apparatus of FIG. 2 can store a larger number of articles S between the producing and consuming machines provided that the combined capacity of surge bins 135, 151 exceeds the capacity of the surge bin 35 of FIG. 1. The surge bin 135 (hereinafter called primary surge bin) is installed at a level above the other (secondary or auxiliary) surge bin 151. The latter comprises a mobile bottom wall which constitutes the upper reach of an endless conveyor belt 152 connected with a mobile end wall 156 which is reciprocable in directions indicated by a double-headed arrow 157. The conveyor belt 152 is trained over rollers 153*a*, 153*b*. The roller 135*b* receives torque from a prime mover, here shown as a reversible electric motor 154, when the latter receives an appropriate signal from the output of a control unit 166 whose input is connected to the output d of a control unit 161 for the reversible motor 137 which drives the belt 138 and end wall 141 of the primary surge bin 135. The end wall 156 of the surge bin 151 can actuate a first limit switch 158 (when the surge bin 151 is filled to capacity) whereby the switch 158 causes the prime mover of the producing machine to come to a full stop. A further limit switch 159 is actuated when the surge bin 151 is empty, and the switch 159 then transmits a signal to the input b of the control unit 161. The input a of the control unit 161 receives a signal from the limit switch 142 which is actuated by the end wall 141 when the primary surge bin 135 is filled to capacity, and the output c of the control unit 161 is connected with the motor 137. A further input e of the control unit 161 receives signals from the sensor 132 via switch 134.

The control unit 166 for the motor 154 has a second input which is connected with a switch 164 actuatable by a pivotable sensor 163 mounted in the end wall 170 of the secondary surge bin 151 opposite the mobile end wall 156. The sensor 163 is biased clockwise, as viewed in FIG. 2, by a suitable spring (not shown). The control unit 166 is a coventional logic circuit. The arrangement is such that, when the articles S exert a predetermined pressure against the convex side of the sensor 163, the latter actuates the switch 164 which causes the control unit 166 to erase the signal from the output d of the control unit 161. On the other hand, when the pressure of articles S against the sensor 163 drops to a predetermined minimum value, the switch 164 transmits a signal which causes the control unit 166 to accept signals from the output d of the control unit 161. In other words, the signals from the unit 161 can control the operation of the motor 154 as long as the pressure of articles against the sensor 163 is below a preselected maximum pressure.

It is assumed that the auxiliary surge bin 151 is empty, i.e., that the end wall 156 engages the limit switch 159. The sensor 132 above the duct 145 rises or falls, depending upon the ratio of the output of the producing machine to the requirements of the consuming machine, and the signals at the output c of the control unit 161 regulate the operation of the reversible motor 137 for the conveyor belt 138 and mobile end wall 141 of the primary surge bin 135 in the same way as described in connection with the bin 35 of FIG. 1.

If the requirements of the consuming machine are relatively low for an extended period of time, or if the consuming machine is arrested, the primary surge bin 135 is filled to capacity and the end wall 141 actuates the limit switch 142. The switch 142 transmits a signal to the input a of the control unit 161; this causes the control unit 161 to generate signals at the output d in response to changes in the position of the sensor 132 above the duct 145. Thus, the signals at the output c of the control unit 161 disappear and the primary surge bin 135 remains filled to capacity. If the requirements of the consuming machine continue to be lower than the output of the producing machine, the secondary surge bin 151 is also filled to capacity whereby the end wall 156 actuates the limit switch 158 which performs the function of the limit switch 42 of FIG. 1, i.e., it arrests the prime mover of the producing machine.

When the cause of malfunction of the consuming machine is eliminated, the duct 149 begins to deliver articles into the consuming machine proper (or delivers the articles at a higher rate) whereby the sensor 132 pivots anticlockwise and the control unit 161 causes the motor 154 to drive the end wall 156 in a direction to the right so that the contents of the secondary surge bin 151 are admitted into the duct 149. When the end wall 156 reaches and actuates the limit switch 159, the latter transmits a signal to the input b of the control unit 161. This causes the control unit 161 to erase the signals at the output d and to transmit signals to the motor 137 via output c. The end wall 141 then moves away from the limit switch 142 and pushes articles from the primary surge bin 135 into the duct 149. Such movement of the end wall 141 is terminated when the surge bin 135 is empty.

If the pressure of articles upon the sensor 163 (while the end wall 156 moves toward the limit switch 159) exceeds the aforementioned maximum permissible pressure, the sensor 163 actuates the switch 164 which causes the control unit 166 to erase the signal from the output d of the control unit 161. The motor 154 is arrested and remains idle until the pressure upon the sensor 163 drops sufficiently to enable the switch 164 to change the condition of the control unit 166 in such a way that the latter allows signals from the output d of the control unit 161 to reach the motor 154.

An important advantage of the improved apparatus is that the articles S are treated gently during transport toward the duct 45 or 145 above the single surge bin (35) or above the primary surge bin (135). Furthermore, the duct 45 or 145 receives a stream of parallel articles from above so that the articles entering the duct 45 or 145 need not displace any articles which are already confined in the duct. Still further, the speed of the articles does not decrease abruptly on entry into the duct 45 or 145 because the conveyors 1, 2 or 101, 102 feed a multi-layer stream F whose speed is only a fraction of the speed of a single-layer stream or row of rod-shaped articles.

Figure 3A:
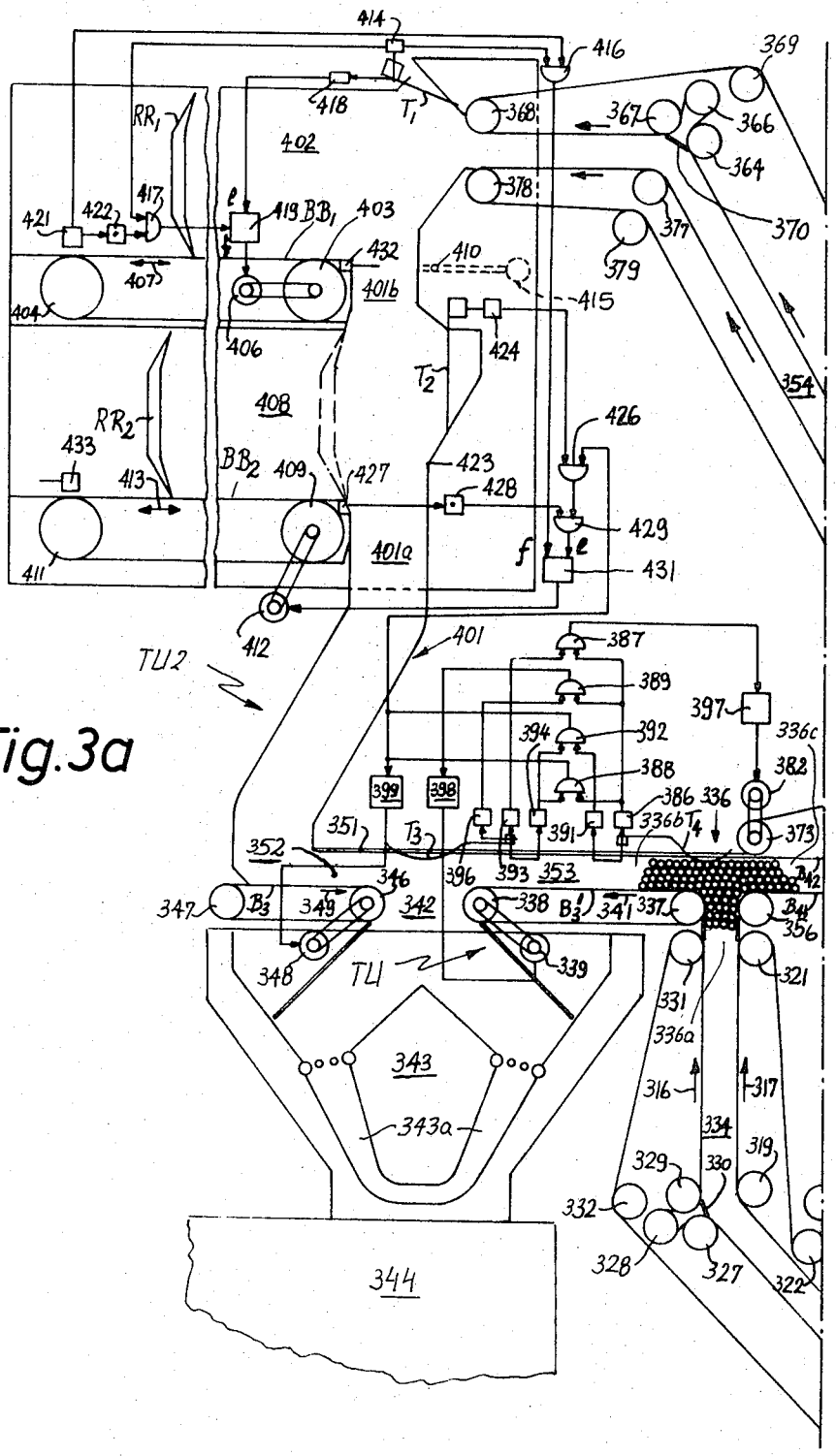
FIGS. 3*a* and 3*b* illustrate an apparatus which embodies another form of the invention and also comprises two surge bins.
Figure 3B:
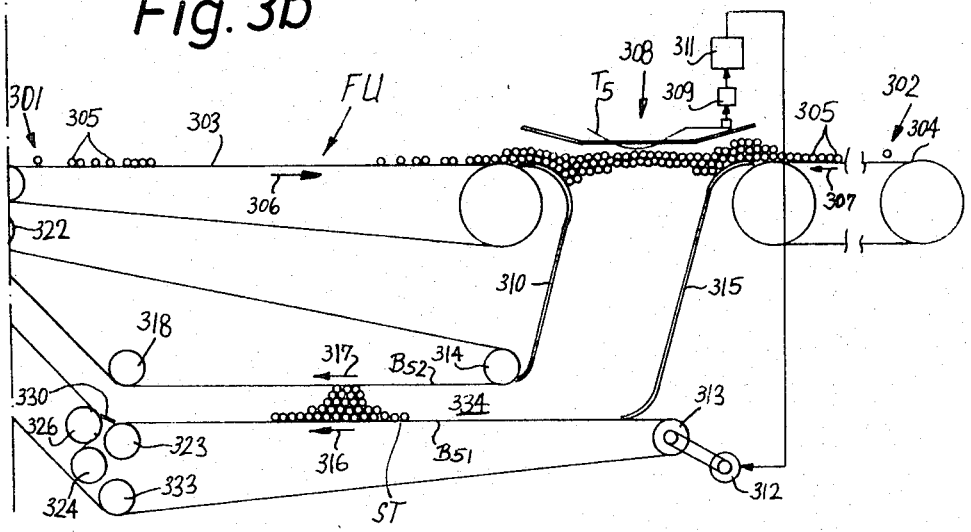

FIGS. 3*a* and 3*b* show an apparatus which delivers rod-shaped articles 305 (e.g., plain or filter tipped cigarettes or filter rod sections) from one or more producing machines to a consuming or processing machine 344. The articles 305 are assumed to constitute cigarettes, and the consuming machine 344 is assumed to be a packing machine which includes a magazine or hopper 343 with customary ducts 343*a* for the assembly of groups or arrays of cigarettes which are thereupon introduced into packs in a manner not forming part of the invention.

The consuming machine 344 can process the output of several producing machines. In the illustrated embodiment, the machine 344 receives the output of two discrete cigarette makers which respectively comprise take-off conveyors 301 and 302. These conveyors can be said to form part of an article feeding or supplying unit FU which delivers a multi-layer stream ST of cigarettes 305 to a T-shaped junction 336. The conveyors 301 and 302 respectively comprise endless belts 303 and 304 each of which delivers a single row or layer of cigarettes 305 to a merging zone 308 at which the rows are converted into the multi-layer stream ST. The cigarette makers may comprise customary accelerating cams (called kickers) which propel successive cigarettes 305 axially onto the respective belts 303, 304 and the belts thereupon move the cigarettes sideways toward the merging zone 308. The stream ST is transported to the inlet 336*a* of the junction 336 by two additional conveyors of the feeding unit FU, namely, by a first conveyor or duct having side walls 310 and 315 and by a composite second conveyor including two endless belts B51 and B52. The cigarettes 305 on the belts 303 and 304, in the duct 310, 315 and in the channel 334 between the belts B51 and B52 travel sideways. The directions in which the upper reaches of the belts 303 and 304 advance cigarettes 305 toward the merging zone 305 are denoted by arrows 306 and 307. Each producing machine may constitute a plain cigarette maker of the type known as GARANT (trademark) produced by Hauni-Werke Körber & Co. KG, of Hamburg, Federal Republic Germany. If the articles 305 are filter rod sections, they can be produced in a machine known as KDF (also produced by Hauni-Werke).

The outlet of the path defined by the feeding unit FU, namely that portion of the channel 334 wherein the stream ST advances towards and into the inlet 336*a* of the junction 336, extends vertically upwardly, i.e., the junction 336 receives a multi-layer stream of cigarettes from below.

The upper level of the pile of articles in the upper part of the duct 310, 315 of the feeding unit FU is monitered by a pivotal sensor T5 having a convex underside which rests on the uppermost layer of cigarettes between the belts 303 and 304. The sensor T5 transmits signals to a control amplifier 311 via switch 309, and the amplifier 311 starts a prime mover 312 for the driven pulleys 313, 314 for the belts B51, B52 when the pressure of cigarettes 305 against the underside of the sensor T5 exceeds a predetermined value. This insures that the duct 310, 315 is always filled with cigarettes and that the belts B51, B52 deliver to the inlet 336*a* a continuous stream ST of cigarettes. The directions in which the prime mover 312 drives the belts B51, B52 are respectively indicated by arrows 316 and 317. The sensor T5 automatically arrests the prime mover 312 when the upper level of cigarettes 305 in the duct 310, 315 sinks so that the pressure of cigarettes against the underside of the sensor drops below the predetermined value.

The belt B52 is further trained over idler pulleys or rollers 318, 319, 321 and 322. The belt B51 is further trained over idler pulleys or rollers 323, 324, 326, 327, 328, 329, 331, 332 and 333. Stationary arcuate guides 330 are installed between the pulleys 323, 326 and 327, 329; the concave sides of these guides contact the adjacent layer of the stream ST in the relatively narrow gaps where the belt B51 is out of contact with the stream.

The junction 336 comprises a first outlet 336*b* which admits a multi-layer stream of cigarettes 305 into a channel 353 defined by a (third) transporting unit TU serving to deliver cigarettes directly from the junction 336 into the intake 342 of the magazine 343 of the packing machine 344. The transporting unit TU comprises an endless belt B3′ which is trained over pulleys 337, 338 and can be driven by an operating means or prime mover 339 so that its upper reach moves in the direction indicated by arrow 341. The driven pulley 338 for the belt B3′ is adjacent to one side of the intake 342.

A second outlet 336*c* of the junction 336 can admit a multi-layer stream of cigarettes 305 into a channel 354 which is defined by a (first) transporting unit TU1 serving to deliver cigarettes to storing means including a pair of superimposed variable-capacity reservoirs 402, 408 of the type called surge bins. A (second) transporting unit TU2 is provided to deliver cigarettes 305 from the surge bin 408 or 402 into the intake 342 of the magazine 343 when the rate at which the transporting unit TU can deliver cigarettes does not suffice to meet the requirements of the packing machine 344 or when the unit TU is idle while the machine 344 continues to process the cigarettes. The transporting unit TU2 comprises a downwardly extending conveyor here shown as a duct 401 and a horizontal conveyor including an endless belt B3 and a stationary cover or top wall 351. The cover 351 defines with the belt B3 a horizontal channel 352 which receives cigarettes 305 from the lower end of the duct 401 and delivers such cigarettes to the intake 342 of the magazine 343 when the transporting unit TU2 is operated, i.e., when the transporting unit TU cannot meet the requirements of the packing machine 344. The belt B3 is trained over pulleys 346, 347 and can be driven by an operating means or prime mover 348 so that its upper reach moves in the direction indicated by arrow 349. The pulley 346 is adjacent to the intake 342 opposite the pulley 338 for the belt B3'. It will be noted that the cover 351 overlies the intake 342 as well as the upper reach of the belt B3', i.e., this cover extends all the way to the corresponding outlet 336*b* of the junction 336.

The transporting unit TU1 comprises two endless article feeding conveyor belts B41 and B42 which define the channel 354. The first portion of the channel 354 (namely that portion which receives a multi-layer stream of cigarettes 305 from the outlet 336*c*) is horizontal; the channel 356 thereupon extends upwardly and its discharge end is horizontal or nearly horizontal. Such discharge end is located at a level above the junction 336 and at a level above at least one of the surge bins 402, 408. The belt B41 is trained over pulleys or rollers 356, 357, 358, 359, 361, 362, 363, 364, 366, 367, 368, 369, 371 and 372. The belt B42 is trained over pulleys or rollers 373, 374, 376, 377, 378, 379 and 381. The reference characters 370 denote arcuate guides which are interposed between the pulleys 357, 359 and 361, 363 and 364, 367; the concave sides of these guides are adjacent to the cigarette stream in the channel 354 where the stream is out of contact with the belt B41. The pulleys 356 and 373 can be driven by an operating means or prime mover 382 to move the belts B41 and B42 in directions indicated by arrows 383 and 384.

A sensor T4 rests on the uppermost layer of the cigarette stream in the junction 336 above the inlet 336*a*. The sensor T4 may constitute a pivotably mounted plate having a convex underside which rests on the topmost layer of cigarettes 305 therebelow. When the sensor T4 is pivoted anticlockwise, as viewed in FIG. 3*a*, i.e., when the pile of cigarettes 305 above the inlet 336*a* rises to increase the pressure against the underside of the sensor T4, the sensor T4 transmits a signal to or otherwise actuates a switch 386 which, in turn, transmits a signal to the corresponding inputs of three AND-gates 387, 388 and 389. When the cigarettes 305 above the inlet 336*a* permit the sensor T4 to pivot clockwise, the sensor actuates a switch 391 which transmits a signal to the corresponding input of an AND-gate 392.

A third sensor T3 is installed above the intake 342 of the magazine 343. The sensor T3 is pivotable or otherwise movable between an upper end position (when the magazine 343 is completely filled) in which it actuates a switch 393 which transmits a signal to the other input of the AND-gate 387, a lower end position (when the supply of cigarettes 305 in the magazine 343 has been depleted to a predetermined lowermost level) in which the sensor actuates a switch 394 which transmits a signal to the other inputs of AND-gates 388 and 392, and a plurality of intermediate positions in which the sensor T3 actuates a switch 396 serving to transmit signals to the other input of the AND-gate 389 when the pressure of cigarettes against the sensor is somewhere between the maximum and minimum pressures.

The outputs of the AND-gates 388 and 392 are connected with an amplifier 399 which can start or arrest the prime mover or operating means 348 for the belt B3 of the transporting unit TU2. The exact construction of the amplifier 399 (which may constitute a relay or an electronic amplifying circuit) depends on the type of prime mover which is employed to drive the belt B3. The same applies for an amplifier 398 which receives signals from the output of the AND-gate 389 and serves to start or arrest the prime mover or operating means 339 for the belt B3'. An analogous amplifier 397 is connected with the output of the AND-gate 387 and serves to start or arrest the prime mover or operating means 382 for the belts B41, B42 of the transporting unit TU1.

The duct 401 of the transporting unit TU2 is substantially vertical and its upper end is adjacent to and receives cigarettes 305 from the discharge end of the channel 354 when the prime mover 382 for the belts B41 and B42 is on. The lower end of the duct 401 delivers cigarettes 305 onto the upper reach of the belt B3 when the rate at which the transporting unit TU can supply cigarettes 305 to the magazine 343 is less than that which is needed to satisfy the momentary requirements of the packing machine 344.

The sensors T3, T4, the prime movers 339, 348, 382 and the associated switches, logic circuits and amplifiers constitute a control system for the transporting units TU, TU1 and TU2.

The surge bins 402 and 408 define straight horizontal compartments for temporary storage of cigarettes when the magazine 343 is filled to capacity and the feeding unit FU continues to deliver cigarattes to the inlet 336*a* of the junction 336. The transporting unit TU1 is then operated by the prime mover 382 and the channel 354 feeds a continuous stream of cigarattes to the opening or inlet at the right-hand end of the upper surge bin 402. The latter comprises an endless conveyor belt BB1 having a horizontal upper reach which constitutes a mobile bottom wall of the surge bin 402 and is connected with an upwardly extending end wall RR1 movable toward and away from the discharge end of the channel 354 (see the double-headed arrow 407). The belt BB1 is trained over pulleys 403, 404 and can be driven by a reversible prime mover 406. The volume of the surge bin 402 increases when the end wall RR1 is moved to the left, as viewed in the drawing, and the end wall RR1 expels cigarettes 305 from the surge bin 402 when the prime mover 406 rotates the pulley 403 in a clockwise direction. The inlet of the surge bin 402 serves as an outlet when the end wall RR1 moves toward the duct 401.

The lower surge bin 408 is preferably identical with the upper surge bin 402, i.e., the maximum capacity of surge bins 402 and 408 is the same. The endless belt BB2 of the surge bin 408 is trained over pulleys 409, 411 and the upper reach of the belt BB2 is connected with an end wall RR2 which is movable in directions indicated by a double-headed arrow 413. The pulley 409 can be rotated by a reversible prime mover 412.

It has been found that two or more straight horizontal surge bins which are disposed one above the other occupy relatively little space but can store surprisingly large quantities of delicate rod-shaped articles without any deformation or other damage. Furthermore, such superimposed surge bins can be installed in a common frame. The length of each surge bin, as considered in the direction of movement of their mobile end walls, is preferably identical.

The cross-sectional area of the portion 401*a* of the duct 401 below the lower surge bin 408 can and preferably does exceed the cross-sectional area of the portion 401*b* above the inlet of the lower surge bin 408 and/or the cross-sectional area of the duct portion (if any) above the inlet of the upper surge bin 402. This prevents the cigarettes 305 from falling into the duct 401 from a level above the surge bin 402 during movement of the end wall RR1 toward the duct 401 and/or the descent of cigarettes from the surge bin 402 into the duct 401 while the end wall RR2 moves to the right, as viewed in the drawing. At the very least, the provision of constrictions in the duct 401 above the surge bins 402 and 408 reduces the likelihood of descent of cigarettes from the bin 402 or from the channel 354 during expulsion of the contents of the surge bins 408 and 402 respectively.

If is further desirable (but optional) to provide the apparatus with a gate 410 (shown by broken lines) which is reciprocable across the duct portion 401*b* by a reversible prime mover 415 to seal the upper surge bin 402 from the duct portion 401*a* while the latter receives cigarettes 305 from the lower surge bin 408. The prime mover 415 can be designed to gradually move the gate 410 to sealing position during evacuation of the contents of the lower surge bin 408.

A sensor T1 is pivotably mounted at the upper end of the duct 401 (to the left of the discharge end of the channel 354) to monitor the upper level of the supply cigarettes 305 in the transporting unit TU2. When the pressure of cigarettes against the underside of the sensor T1 increases, the latter pivots anticlockwise toward an upper end position in which it actuates a switch 414 so that the latter transmits a signal to the corresponding inputs of two AND-gates 416 and 417. When the pressure of cigarettes 305 against the underside of the sensor T1 decreases to a predetermined minimum value, the sensor actuates a switch 418 which transmits a signal to the corresponding input 1 of an amplifier 419. The amplifier 419 is a relay or an electronic circuit, depending on the nature of the reversible prime mover 406 for the belt BB1 of the upper surge bin 402. When the input 1 of the amplifier 419 receives a signal, the prime mover 406 is caused to move the end wall RR1 toward the duct 401, i.e., the volume of the upper surge bin 402 decreases and the contents of the surge bin 402 are admitted into the duct 401 of the transporting unit TU2.

When the upper surge bin 402 is completely filled with cigarettes 305, the end wall RR1 actuates a limit switch 421 which transmits signals to the other inputs of the AND-gates 416, 417 (the gate 417 receives such signals by way of a NO-gate or inverter 422). The output of the AND-gate 417 is connected with the input f of the amplifier 419; when the input f receives a signal (in response to transmission of signals to both inputs of the AND-gate 417), the amplifier 419 causes the prime mover 406 to drive the end wall RR1 toward the limit switch 421, i.e., to increase the volume of the surge bin 402. This takes place when the surge bin 402 is at least partially empty because the NO-gate 422 transmits a signal (to 417) only when its input does not receive a signal from the limit switch 421.

A further sensor T2 is installed in that wall 423 of the duct 401 which is located opposite the opening or inlet of the lower surge bin 408. The sensor T2 is responsive to the pressure of cigarettes 305 in the bin 408 (its upper end is pivotally mounted in the frame of the apparatus) and serves to actuate a switch 424 when the pressure of cigarettes against its left-hand side decreases. The switch 424 transmits a signal to the corresponding input of an AND-gate 426; the other input of the AND-gate 426 is connected with the output of the AND-gate 392.

A limit switch 427 in the path of rightward movement of the end wall RR2 of the lower surge bin 408 is actuated when the surge bin 408 is empty. The corresponding end position of the end wall RR2 is indicated by broken lines. The switch 427 then transmits a signal to one input of an AND-gate 429 by way of a NO-gate or inverter 428. The outer input of the AND-gate 429 is connected with the output of the AND-gate 426.

The output of the AND-gate 429 is connected with the input 1 of an amplifier 431 whichis analogous to the amplifier 419 and serves to regulate the operation of the prime mover 412 for the belt BB2 of the lower surge bin 408. When the input 1 of the amplifier 431 receives a signal, the motor 412 drives the end wall RR2 toward the sensor T2 to expel cigarettes from the surge bin 408. Another input f of the amplifier 431 is connected with the output of the AND-gate 416; when the gate 416 transmits a signal, the amplifier 431 causes the motor 412 to move the end wall RR2 away from the sensor T2, i.e., the volume of the lower surge bin 408 increases.

A limit switch 432 is installed in the path of movement of the end wall RR1 in the upper surge bin 402. When the end wall RR1 actuates the switch 432 (i.e., when the upper surge bin 402 is empty), the switch 432 transmits a signal which arrests the prime mover (not shown) of the packing machine 344.

An additional limit switch 433 is actuated by the end wall RR2 when the lower surge bin 408 is filled to capacity. The switch 433 then arrests the prime movers (not shown) of the producing machines, i.e., the belts 303 and 304 cease to supply cigarettes 305 to the merging zone 308.

The prime movers 312, 338, 348, etc. and the previously mentioned prime movers are preferably rotary electromagnets, i.e., electric motors belonging to the class of polyphase induction motors. Such prime movers are preferred at this time because they are not sensitive to thermal stresses which develop or are likely to develop in response to repeated starting and stoppage.

The sensors T1, T2, the prime movers 406, 412, and the associated switches, amplifiers, and logic circuits constitute a regulating system for the surge bins 402, 408. The prime movers 406, 412 effect the admission of cigarettes 305 into the respective magazines, the amplifier 431 effects the delivery of cigarettes from the surge bin 408 into the duct 401, and the amplifier 419 thereupon effects the delivery of cigarettes from the surge bin 402 into the duct 401. The switch 414 activates the prime movers 406, 412 in response to increasing pressure of cigarettes 305 against the sensor T1, the switch 418 activates the amplifier 419 in response to decreasing pressure of cigarettes against the sensor T1, and the switch 424 activates the amplifier 431 in response to decreasing pressure of cigarettes against the sensor T2.

The operation of the apparatus of FIGS. 3*a* and 3*b* is as follows:

The cigarettes 305 which issue from the two producing machines are transported by the belts 303 and 304 toward and into the merging zone 308. The single rows of cigarettes which are supplied by the belts 303 and 304 are converted into the multi-layer stream ST by descending into the interior of the duct including the stationary side walls 310 and 315. When the height of the pile of cigarettes 305 in the duct 310, 315 increases sufficiently to pivot the sensor T5 beyond a predetermined position, the sensor actuates the switch 309 which causes the amplifier 311 to start the prime mover 312 for the pulleys 313 and 314 so that the belts B51 and B52 advance the stream ST in the channel 334 toward and into the inlet 336*a* of the junction 336. The article-engaging reaches of the belts B51 and B52 then respectively move in the directions indicated by arrows 316 and 317. As mentioned above, the last portion of the channel 334 extends vertically upwardly so that the junction 336 receives cigarettes from below.

It is assumed that the cigarettes 305 in the intake 342 of the magazine 343 maintain the sensor T3 in an intermediate position so that the cigarettes which fill the junction 336 maintain the sensor T4 in the upper end position. The inputs of the AND-gate 389 then receive signals from the switches 386 (sensor T4) and 396 (sensor T3), and the gate 389 transmits a signal to the amplifier 389 which drives the prime mover 339 for the belt B3' of the transporting unit TU. The belt B3' transports a multi-layer stream of cigarettes from the outlet 336*b* of the junction 336, through the channel 353 and into the intake 342 of the magazine 343. The sensor T3 regulates the delivery of cigarettes along the shortest route (channel 353) by intermittently starting and arresting the prime mover 339.

If the prime mover of the consuming machine 334 is arrested (e.g., in response to a malfunction, such as the failure to deliver material for the making of cigarette packs), the cigarettes 305 at the input 342 pivot the sensor T3 to the upper end position in which the sensor actuates the switch 393 which transmits a signal to the left-hand input of the AND-gate 387. The output of the gate 387 transmits a signal to the amplifier 397 which starts the prime mover 382 for the belts B41 and B42 of the transporting unit TU1. The belts B41 and B42 convey a multi-layer stream of cigarettes 305 from the output 336*c* of the junction 336 through the channel 354 and into the upper end of the duct 401. Such multi-layer stream advances horizontally, thereupon upwardly and finally horizontally toward the inlet of the upper surge bin 402.

If the consuming machine 344 continues to remain idle, the duct 401 cannot deliver articles into the channel 352 and thence into the intake 342 of the magazine 343. Therefore, the pressure of cigarettes 305 against the underside of the sensor T1 above the duct 401 increases and the sensor T1 actuates the switch 414 which transmits signals to the AND-gates 416 and 417. If the upper surge bin 402 is not filled to capacity (i.e., if the limit switch 421 is not actuated by the end wall RR1, the inverter 422 transmits a signal to the other input of the AND-gate 417 so that the output of the gate 417 transmits a signal to the input f of the amplifier 419 which starts the prime mover 406 in a direction to move the end wall RR1 away from the duct 401. Thus, the duct 401 can admit cigarettes 305 into the surge bin 402. When the surge bin 402 is filled to capacity, the limit switch 421 is actuated by the end wall RR1 and transmits a signal to the inverter 422 (i.e., the signal at the output of the AND-gate 417 disappears and the prime mover 406 is arrested) and to the corresponding input of the AND-gate 416. The sensor T1 dwells in the upper end position because the duct 401 receives cigarettes 305 from the transporting unit TU1; therefore, the output of the gate 416 transmits a signal to the input f of the amplifier 431 which causes the prime mover 412 to move the end wall RR2 of the lower surge bin 408 from the broken-line position toward the limit switch 433. Thus, the cigarettes 305 which are delivered by the transporting unit TU1 enter the lower surge bin 408.

If the belts 303 and 304 cease to deliver cigarettes 305 to the merging zone 308 (e.g., due to malfunctioning of the producing machines), the pressure of cigarettes against the underside of the sensor T4 decreases so that the sensor T4 deactivates the switch 386 and actuates the switch 391 which transmits a signal to the right-hand input of the AND-gate 392. It is assumed that the consuming machine 344 is in operation so that the pressure of cigarettes 305 upon the underside of the sensor T3 above the intake 342 decreases and the sensor T3 actuates the switch 394 as soon as the supply of cigarettes in the magazine 343 sinks to the lowest permissible level. The switch 394 then transmits a signal to the left-hand input of the AND-gate 392 and the output of this gate transmits a signal to the amplifier 399 which starts the prime mover 348 for the belt B3, i.e., the transporting unit TU2 begins to deliver cigarettes into the intake 342 of the magazine 343. The cigarettes 305 in the duct 401 descend by gravity in response to starting of the prime mover 348 whereby the pressure of cigarettes upon the sensor T2 decreases. The sensor T2 then actuates the switch 424 which transmits a signal to the AND-gate 426 whose output transmits a signal to the AND-gate 429. The gate 429 transmits a signal to the input 1 of the amplifier 431 which causes the prime mover 412 to move the end wall RR2 toward the sensor T2. Thus, the surge bin 408 feeds cigarettes 305 into the duct 401 and the duct 401 admits such cigarettes into the channel 352 for introduction into the magazine 343.

When the end wall RR2 engages the limit switch 427, the signal at the left-hand input of the AND-gate 429 disappears and the prime mover 412 is arrested. It will be noted that the inverter 428 transmits a signal only as long as the end wall RR2 is remote from the limit switch 427.

If the belt B3 continues to deliver cigarettes 305 into the magazine 343, the pressure against the underside of the sensor T1 decreases whereby the sensor actuates the switch 418 which transmits a signal to the input 1 of the amplifier 419. The latter starts the prime mover 406 which moves the end wall RR1 toward the duct 401 so that the duct 401 receives cigarettes 305 from the upper surge bin 402. It will be seen that the surge bin 402 is filled prior to filling of the surge bin 408, and that the contents of the surge bin 408 are transferred into the duct 401 prior to evacuation of the contents of the surge bin 402. If the cause of malfunction of the producing machines is eliminated prior to complete emptying of the upper surge bin 402, the belts B51 and B52 begin to deliver cigarettes to the inlet 336*a* of the junction 336 and the transporting unit TU begins to deliver cigarettes to the magazine 343 via channel 353. The admission of cigarettes into the magazine 343 is then regulated by sensors T3 and T4 in the aforedescribed manner.

If the belts B51 and B52 cannot deliver cigarettes at a rate which is necessary to meet the requirements of the packing machine 344, for example, when one of the producing machines is out of commission, the pressure upon the underside of the sensor T3 decreases and the sensor T3 is allowed to move to its lower end position in which it actuates the switch 394. The switch 394 transmits a signal to the AND-gates 388 and 392. If the pressure upon the underside of the sensor T4 also decreases, the sensor T4 actuates the switch 391 which transmits a signal to the AND-gate 392. The output of the AND-gate 392 transmits a signal to the amplifier 399 which starts the prime mover 348 for the belt B3 so that the magazine 343 receives cigarettes from the transporting units TU and TU2. When the pressure of cigarettes against the sensor T3 rises, i.e., when the sensor T3 assumes an intermediate position, the output of the AND-gate 389 transmits a signal to the amplifier 398 but the prime mover 399 is idle so that the magazine 343 receives cigarettes only from the transporting unit TU.

It will be seen that, in normal operation, the magazine 343 receives cigarettes from the transporting unit TU. When the output of the producing machines exceeds the requirements of the packing machine 344, the surplus goes into the surge bins 402, 408. When the requirements of the packing machine 344 exceed the output of the producing machine or machines, the magazine 343 receives cigarettes only from the transporting unit TU2 (when the producing machines are idle) or from the transporting unit TU and/or TU2.

Figure 4:
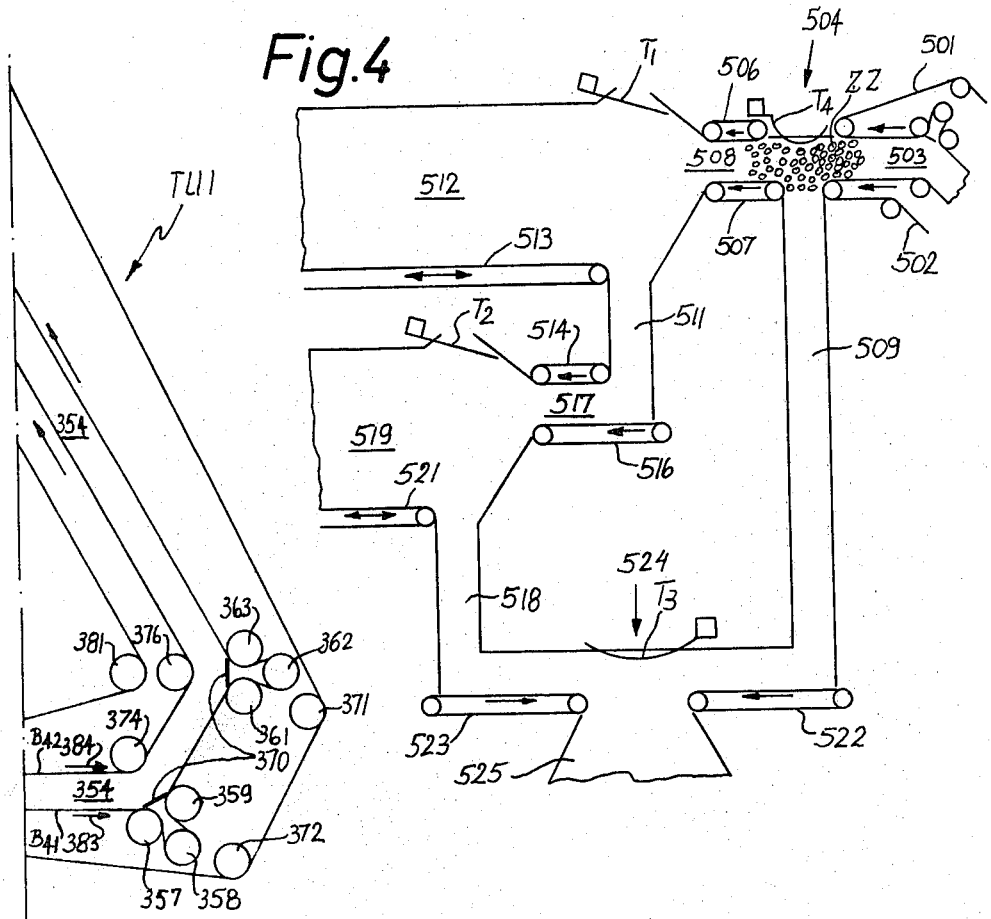
FIG. 4 is a fragmentary side elevational view of an apparatus which embodies a third form of the invention.

FIG. 4 shows a portion of a further apparatus wherein two endless belts 501, 502 define a horizontal channel 503 for a multi-layer stream of cigarettes which are turned out by one or more producing machines, not shown. The channel 503 of FIG. 4 may correspond to the channel 354 defined by the article feeding belts B51 and B52 of FIGS. *3a–3b*. The channel 503 delivers the cigarettes to the inlet of a T-shaped junction 504 one outlet of which can admit a multi-layer stream of cigarettes into a horizontal channel 508 and another outlet of which can admit cigarettes into the upper end of a conveyor here shown as a vertical duct 509. The channel 508 is defined by two endless belts 506 and 507. The prime mover (not shown) for the belts 506, 507 is controlled by a sensor T4 corresponding to the similarly referenced sensor of FIG. *3a*.

The discharge end of the horizontal channel 508 communicates with the upper end of a vertical duct 511 and is located opposite the opening or inlet of a variable-capacity reservoir or surge bin 512. The mobile bottom wall 513 of the surge bin 512 is an endless conveyor belt driven by a reversible prime mover (not shown) which is controlled by a sensor T1 located above the upper end of the duct 511, i.e., adjacent to the discharge end of the channel 508.

The lower end of the duct 511 discharges cigarettes onto the upper reach of a conveyor belt 516 which cooperates with a further conveyor belt 514 to define a horizontal channel 517 wherein a multi-layer stream of cigarettes advances toward the upper end of a further vertical duct 518. The discharge end of the channel 517 is located opposite the opening or inlet of a second variable-capacity reservoir or surge bin 519 having a mobile bottom wall 521 driven by a reversible prime mover (not shown) which is controlled by a sensor T2 located above the upper end of the duct 518 and adjacent to the discharge end of the channel 517. The mobile end walls of the surge bins 512 and 519 are not shown in FIG. 5.

The prime mover for the belts 514, 516 is started in response to a signal from the sensor T1 when the upper surge bin 512 is filled to capacity so that they deliver cigarettes (issuing from the channel 508) into the lower surge bin 519. When the lower surge bin 519 is empty and the pressure of cigarettes against the underside of the sensor T2 decreases (because the duct continues to deliver cigarettes to the consuming machine), the prime mover for the belts 514, 516 is controlled by the sensor T2 so that the channel 517 receives the contents of the upper surge bin 512. At the same time, the sensor T1 causes the mobile end wall of the surge bin 512 to move in a direction to the right and to expel the contents of the surge bin 512 into the duct 511.

The lower ends of the ducts 509 and 518 respectively discharge cigarettes onto the upper reaches of endless conveyor belts 522 and 523 which deliver multi-layer streams of cigarettes to the opposite sides of the intake 524 of a magazine 525 forming part of a consuming or processing machine (e.g., a packing mchine for cigarettes). A sensor T3 above the intake 524 cooperates with the sensor T2 or T4 to actuate the prime mover (not shown) for the belt 522 or 523. If the pressure of cigarettes against the underside of the sensor T4 rises, the magazine 525 receives cigarettes from the duct 509; however, if the rate at which the duct 509 delivers cigarettes does not suffice to satisfy the requirements of the packing machine, the intake 524 receives cigarettes from the belts 522 and 523. When the pressure against the underside of the sensor T4 decreases, the intake 524 receives cigarettes only from the belt 523 provided, of course, that the cigarettes also bear against the underside of the sensor T2.

An advantage of the improved apparatus is that it can sotre substantial quantities of rod-shaped articles in a space-saving manner. This insures that the consuming machine can remain in operation for extended periods of time subsequent to partial or complete shutdown of one or more producing machines. Moreover, and since the means for temporarily storing articles includes a plurality of discrete reservoirs, the lowermost layers of articles in such reservoirs are not subjected to excessive deforming stresses. The apparatus of FIGS. *3a–3b* and 4 exhibit the additional advantage that, in normal operation, the articles reach the consuming machine along the shortest route, i.e., by advancing along the path defined by the transporting unit TU or the transporting unit including the duct 509 and belt 522. The admission of articles into the reservoirs takes place only when the output of the producing machine or machine exceeds the requirements of the consuming machine (this also includes that situation when the consuming machine is idle). If the consuming machine is a packing machine, the likelihood of its stoppage or of its operation at less than normal speed is rather remote so that, under normal circumstances, all articles which are furnished by the producing machine or machines are immediately advanced into the packing machine. In other words, the admission of articles into the upper reservoir or into both reservoirs (the apparatus can comprise three or more reservoirs) takes place at infrequent intervals and normally for relatively short periods of time. Transport of articles along the shortest route during travel from the producing machine to the consuming machine is especially desirable when the articles are cigarettes because repeated changes in direction of movement of cigarettes are likely to cause escape of tobacco particles at the ends.

Another advantage of the improved apparatus is that the reservoirs receive multi-layer streams of articles. This insures that the reduction of the speed of articles on entry into the respective reservoirs is much less pronounced than in apparatus wherein the reservoir receives a single layer or row of articles. The provision of ducts which deliver articles to the inlets of reservoirs also contributes to gentle treatment of articles and reduces the likelihood of deformation or other damage. In the illustrated reservoirs, the inlets serve for reception of articles when the output of the producing machine or machines exceeds the requirements of the consuming machine, and such inlets constitute outlets when the contents of the reservoirs must be evacuated in order to meet the requirements of the consuming machine. The ducts deliver articles from above so that the articles which are admitted into the reservoirs need not displace a large number of articles which are already received in the reservoirs. Such situation would arise if the reservoirs were to receive articles from below.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. In an apparatus for transporting streams of cigarettes, filter rod sections or analogous rod-shaped articles from at least one producing machine to at least one consuming machine, the combination of storing means including a plurality of variable-capacity reservoirs, said reservoirs including a first surge bin and a second surge bin disposed below said first surge bin, each of said surge bins having an opening which constitutes an inlet during admission of articles into and an outlet during evacuation of articles from its interior; a first transporting unit including means for feeding articles into said surge bins when the output of said producing machine exceeds the requirements of said consuming machine; a second transporting unit having means for conveying articles from said surge bins to said consuming machine when the requirements of the consuming machine exceed the output of said producing machine; and control means for effecting the admission of articles into said first surge bin ahead of said second surge bin and the evacuation of articles from said second surge bin ahead of said first surge bin.

2. The combination of claim 1, wherein said control means comprises a first sensor adjacent to the path of articles supplied by said feeding means and operative to produce first signals in response to changing pressure of articles in said path, first and second prime mover means operable to respectively change the volume of said first and second surge bins, means for operating said first and thereupon said second prime mover means to increase the volume of the respective surge bins in response to said first signals while the pressure of articles against said first sensor increases and for operating said first prime mover means to reduce the volume of said first surge bin while the pressure of articles against said first sensor decreases, a second sensor adjacent to the path of articles from said second surge bin to said second transporting unit and operative to produce second signals in response to decreasing pressure of articles in said second surge bin, and means for operating said second prime mover means to reduce the volume of said second surge bin while the pressure of articles against said second sensor decreases.

3. The combination of claim 1, wherein said second transporting unit comprises duct means arranged to transport articles from a first level to a lower second level and communicating with the openings of said surge bins.

4. The combination of claim 3, wherein said duct means has a first portion of larger cross-sectional area below the opening of said second surge bin and a second portion of smaller cross-sectional area between the openings of said first and second surge bins.

5. The combination of claim 3, further comprising a gate and means for moving said gate across said duct means intermediate the openings of said first and second surge bins.

6. The combination of claim 1, wherein said surge bins define elongated straight compartments for temporary storage of articles, said compartments having identical lengths.

7. The combination of claim 1, wherein said feeding means comprises conveyor means arranged to supply a multi-layer stream of articles to a level above said openings and said conveying means of said second transporting unit comprises a device which is arranged to transport a multi-layer stream downwardly from a location below said openings.

8. The combination of claim 7, wherein said openings are disposed intermediate said level and said device, and the respective surge bins extend laterally of said second transporting unit.

9. The combination of claim 7, wherein said first transporting unit further comprises an upright duct arranged to convey articles from said level to the opening of said first surge bin.

10. The combination of claim 7, wherein said device is a duct having an upper end below the opening of said second surge bin.

11. The combination of claim 1, further comprising an article feeding unit which receives articles from said producing machine, a junction having inlet means receiving articles from said feeding unit and outlet means communicating with said first transporting unit, and a third transporting unit having means for delivering articles from said outlet means directly to said consuming machine, and means for actuating said first transporting unit when the ratio of articles delivered to said inlet means to articles delivered to said consuming machine is above a predetermined value and for actuating said third transporting unit when said ratio drops below said value.

12. The combination of claim 11, wherein said feeding unit comprises conveyor means arranged to deliver to said inlet means a multi-layer stream of articles from below.

13. The combination of claim 11, wherein said producing machine comprises means for supplying a single layer of articles sideways and further comprising means for converting said layer into a multi-layer stream not later than in said feeding unit.

14. The combination of claim 1, wherein said transporting units include prime movers and at least one of said prime movers is a rotary electromagnet.

15. The combination of claim 1, wherein said surge bins are located above said machines and further comprising a common frame for said surge bins.

16. The combination of claim 1, wherein at least one of said transporting units defines a path wherein the articles move substantially horizontally and substantially vertically.

17. The combination of claim 1, wherein the opening of one of said surge bins is in permanent communication with the opening of the other of said surge bins.

18. In an apparatus for transporting streams of cigarettes, filter rod sections or analogous rod-shaped articles from at least one producing machine to at least one consuming machine, the combination of storing means including a plurality of variable-capacity reservoirs, said reservoirs including a first surge bin and a second surge bin disposed below said first surge bin, each of said surge bins having an opening which constitutes an inlet during admission of articles into and an outlet during evacuation of articles from its interior; a first transporting unit including means for feeding articles into said surge bins when the output of said producing machine exceeds the requirements of said consuming machine; and a second transporting unit having means for conveying articles from said surge bins to said consuming machine when the requirements of the consuming machine exceed the output of said producing machine, said means for conveying including a first duct having an upper end communicating with the opening of said first surge bin and a lower end, a conveyor defining a substantially horizontal path having a first end communicating with the lower end of said duct and a second end communicating with the opening of said second surge bin, and a second duct having an upper end communicating with the opening of said second surge bin.

19. The combination of claim 1, further comprising means for feeding articles from the producing machine, a junction having inlet means for the articles delivered by said feeding means and outlet means, said first transporting unit having an inlet communicating with said outlet means, and a third transporting unit having an inlet communicating with said outlet means and having an outlet communicating with said consuming machine.

20. The combination of claim 19, further comprising means for operating said third transporting unit when the rate at which said inlet means receives articles from said feeding means at least partially satisifies the requirements of said consuming machine, means for operating said first transporting unit when the rate at which said inlet means receives articles exceeds the requirements of said consuming machine, and means for operating said second transporting unit when the requirements of said consuming machine exceed the rate of article delivery by said feeding means.

21. The combination of claim 19, wherein said feeding means includes a conveyor arranged to deliver to said inlet means a multi-layer stream of articles from below.

22. The combination of claim 19, wherein said feeding means includes means for converting at least one row of articles into a multi-layer stream and means for conveying said stream to said inlet means.

* * * * *